United States Patent [19]

Nishio

[11] 4,303,048

[45] Dec. 1, 1981

[54] ENGINE ROTATION SPEED CONTROL SYSTEM

[75] Inventor: Shigeru Nishio, Kariya, Japan

[73] Assignee: Aisin Seiki Kabushiki Kaisha, Kariya, Japan

[21] Appl. No.: 117,922

[22] Filed: Feb. 4, 1980

[30] Foreign Application Priority Data

Feb. 9, 1979 [JP] Japan ..... 54-14695

[51] Int. Cl.[3] ..... F02M 3/00; F02M 23/00

[52] U.S. Cl. ..... 123/339; 123/327; 123/438; 123/472; 123/585; 123/623; 123/571

[58] Field of Search ..... 123/585, 438, 440, 439, 123/588, 589, 491, 472, 623, 624, 625, 327, 339, 333, 571

[56] References Cited

U.S. PATENT DOCUMENTS

| | | | |
|---|---|---|---|
| 1,611,826 | 12/1976 | Fischer-Hinnen | 123/623 |
| 2,223,151 | 11/1940 | Nadler et al. | 123/624 |
| 2,586,962 | 2/1952 | Kleis | 123/624 |
| 2,807,729 | 9/1957 | Redick | 123/624 X |
| 3,718,124 | 2/1973 | Burley | 123/624 |
| 4,099,508 | 7/1978 | Noguchi et al. | 123/624 |
| 4,106,462 | 8/1978 | Hildebrandt et al. | 123/623 |
| 4,231,733 | 11/1980 | Hickam et al. | 123/438 |
| 4,233,947 | 11/1980 | Abo | 123/571 |
| 4,240,145 | 12/1980 | Yano et al. | 123/585 |

FOREIGN PATENT DOCUMENTS

| | | | |
|---|---|---|---|
| 2705227 | 11/1977 | Fed. Rep. of Germany | 123/438 |
| 55-66646 | 5/1980 | Japan | 123/438 |

*Primary Examiner*—Wendell E. Burns

*Attorney, Agent, or Firm*—Sughrue, Mion, Zinn, Macpeak and Seas

[57] ABSTRACT

An engine rotation speed control system for automotive vehicles having internal combustion engines comprises a solenoid actuated valve having a solenoid coil for controling the flow of air through a throttle bypass passage to the intake manifold during engine idling upon energization of the solenoid coil. The electrical circuit for the solenoid coil is provided with a variable resistance arrangement so that sufficient current will be supplied to the solenoid coil upon engine starting in spite of a voltage drop in the battery at cold temperatures.

4 Claims, 4 Drawing Figures

ENGINE ROTATION SPEED CONTROL SYSTEM

BACKGROUND OF THE INVENTION

1. Field of the Invention

The present invention relates to an engine rotation speed control system and more particularly to an engine rotation speed control system for internal combustion engines which will ensure a predetermined speed of engine rotation during idling by supplying sufficient air to the intake manifold through solenoid actuated valve means.

2. Prior Art:

It is well known that during idling of an internal combustion engine, the low rotational speed thereof is subject to wide fluctuation due to the effect of various external conditions.

In the past, an engine rotation speed control system has been proposed in order to stabilize engine rotation speed by supplying the required amount of air to the intake manifold downstream of the throttle valve which is substantially closed during idling. Such an engine rotation speed control system is equipped with a solenoid-actuated valve having a solenoid coil so that the air volume to be supplied to the intake manifold is increased or decreased by increasing or decreasing, respectively, the strength of the electrical current flowing in the solenoid coil. In other words, the air volume is in direct linear proportion to the strength of the electric current. Such an engine rotation speed control system is also equipped with a control unit which determines the optimum strength for the electrical current flowing in the solenoid coil by reflecting various conditions such as the temperature of the engine cooling water or actual engine rotational speed on the assumption that the voltage of the battery which supplies electrical current to the solenoid coil is constant. Thus, the air volume to be supplied to the intake manifold downstream of the throttle valve is determined in accordance with the various conditions as mentioned above under the assumption of constant battery voltage. However, it is well known that the voltage of a battery will drop at cold temperatures. Therefore, the foregoing conventional engine rotation speed control system suffers the drawback that the required volume of air is not supplied to the intake manifold downstream of the throttle valve through the solenoid-actuated valve since the solenoid-actuated valve would not receive sufficient current.

SUMMARY OF THE INVENTION

It is therefore, one of the objects of the present invention to provide an improved engine rotation speed control system without the aforementioned drawback of the prior art system.

It is another object of the present invention to provide an engine rotation speed control system comprising a solenoid actuated valve disposed in a throttle bypass passage wherein the solenoid coil of the solenoid-actuated valve is connected to the battery in series with a resistance which may be by-passed when starting the engine at cold temperatures to provide sufficient current to the coil so that sufficient air will be passed by the solenoid-actuated valve during idling. The optimum current for the solenoid coil is provided for all operating conditions by an electronic control circuit responsive to various engine operating parameters.

The foregoing and other objects, features and advantages of the invention will be apparent from the following more particular description of the preferred embodiment of the invention as illustrated in the accompanying drawings.

DETAILED DESCRIPTION OF THE INVENTION

Figure 1:
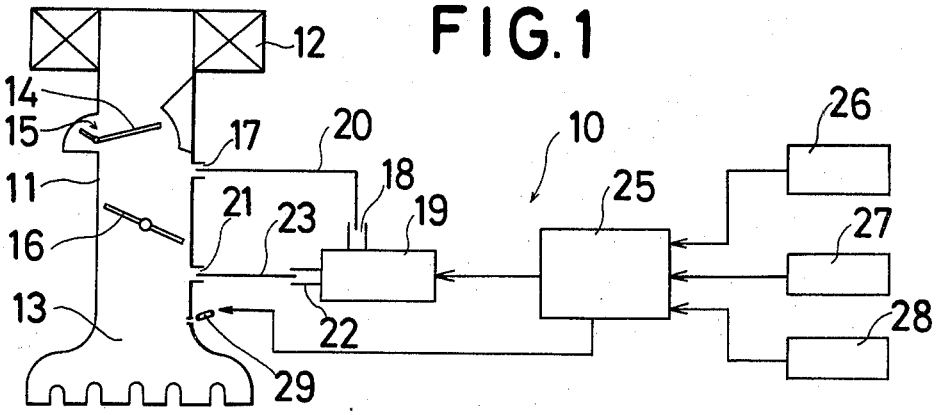
FIG. 1 is a schematic view of the engine rotation speed control system in accordance with the present invention.

Referring to FIG. 1, which is a schematic illustration of an engine rotation speed control system 10, a carburator 11 is provided with an air cleaner 12 at the upper end thereof. A measuring plate 14 of an airflow meter 15 is located between the air cleaner 12 and the throttle valve 16. An upper port 17 is located in the carburator 11 between the measuring plate 14 and the throttle valve 16 and is connected to an inlet port 18 of a solenoid-actuated valve 19 via conduit 20. A lower port 21, positioned in the intake manifold 13 of the carburator, is connected to an outlet port 22 of the solenoid-actuated valve 19 via conduit 23. The solenoid-actuated valve 19 and the conduits 20 and 23 constitute a throttle bypass for supplying sufficient air volume to the intake manifold 13 during idling of the engine to increase the engine rotation speed when the engine is started at cold temperatures.

Figure 2:
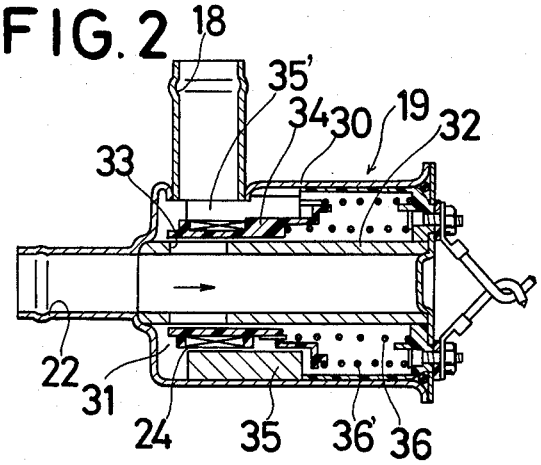
FIG. 2 is a sectional view of a solenoid-actuated valve suitable for inclusion in the engine control system of FIG. 1.

The solenoid-actuated valve 19, as illustrated in FIG. 2, is provided with a solenoid coil 24 and the air volume flowing from the inlet port 18 to the outlet port 22 is in linear proportion to the strength of the electric current supplied to the solenoid coil 24 due to control unit 25. The control unit 25 is connected to an air flow sensor 26, a thermal-sensor 27 and an ignition timing sensor 28 so as to receive signals from these three sensors to determine the optimum strength of the electric current to be supplied to the solenoid coil 24. The control unit 25 is also connected to a fuel injector to determine optimum fuel injection timing and duration.

The solenoid-actuated valve 19 is comprised of a casing 30 having an inlet port 18, an outlet port 22, an inner chamber 31 defined in the casing 30 in communication with port 18, a hollow magnetic core 32 in communication with the port 22 and having passages 33 therethrough, a bobbin 34 of non-magnetic material slidingly mounted on the core 32, a solenoid coil 24 wound on said core, a pair of permanent magnets 35, 35' positioned within the casing 30 so that the magnetic flux intersects the solenoid coil 24 at right angles and springs 36, 36' biasing the bobbin 34 so as to close the passages 33 in the absence of an electric current to the coil 24.

Upon energization of the solenoid coil 24, the bobbin 34 is displaced to the right as viewed in FIG. 2 against the spring means 36 according to Fleming's left-hand rule and a volume of air is drawn into the intake manifold 13 from the outlet port 22 of the solenoid-actuated valve 19. The volume of aid drawn into the intake manifold 13 is determined by the axial displacement of the bobbin 34 which is in turn controlled by the strength of the electric current supplied to the solenoid coil 24.

Figure 3:
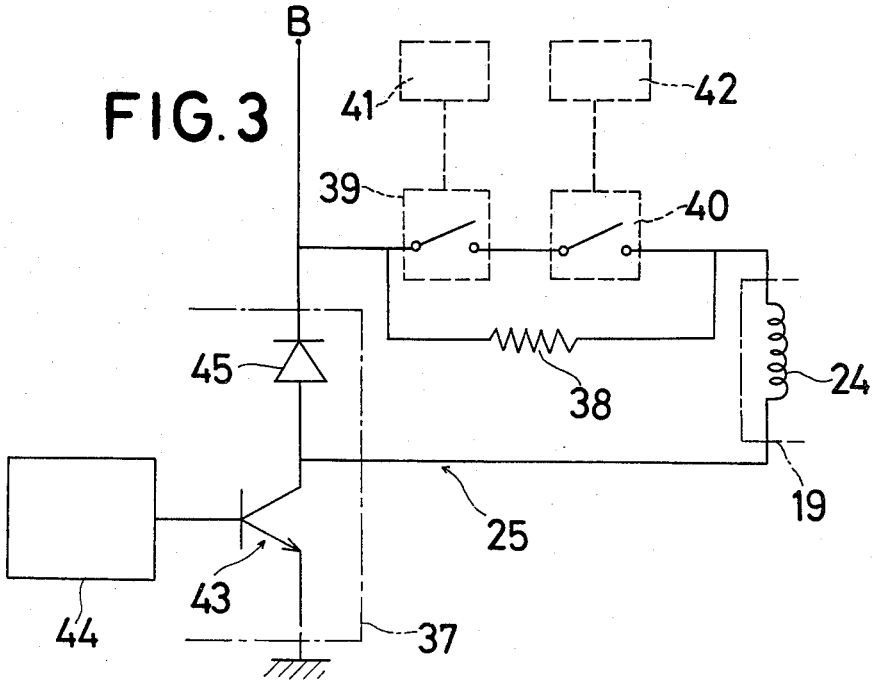
FIG. 3 is a circuit diagram for the energization of the solenoid coil of the solenoid-actuated valve of FIG. 2.

The control unit 25 for determining the optimum strength of the electric current to be supplied to the solenoid coil 24 is illustrated in detail in FIG. 3. The control unit 25 includes a control circuit 37, a resistor 38 which connects one end of the solenoid coil 24 directly to the battery B and first and second switches 39 and 40 connected in series between said one end of the solenoid coil 24 and the battery B. The first switch 29 is so linked to an ignition switch 41 that the on-off condition of the latter corresponds to the on-off condition of the former. The second switch 40 is linked to a bi-metallic thermostatic sensor 42 so as to be closed when the ambient temperature around the engine is lowered below a set cold temperature limit. Thus, the resistor 38 will be by-passed and said one end of the solenoid coil 24 will be directly connected to the battery B when the ignition switch 41 is turned on at a cold temperature below the limit.

The control circuit 37 is provided with a switching transistor 43, a pulse modulator 44 and a diode 45. The switching transistor 43 is connected at the base thereof to the pulse modulator 44, at the emitter thereof to the ground and at the collector thereof directly to the other end of the solenoid coil 24. The pulse modulator 24 transmits a pulse signal, the width of which is in accordance with the external conditions detected by the sensors 26, 27 and 28. The optimum strength of the electric current flowing in the solenoid coil 24 may be controlled by varying the width of the pulse signal on the assumption that the voltage of battery B is constant although said one end of the solenoid coil 24 is connected to the battery B directly or through resistor 38. The diode 45 is interposed between the battery B and the collector of the switching transistor 43 so as to prevent reverse current to the switching transistor 43 from the solenoid coil 24 upon de-energization thereof.

Figure 4:
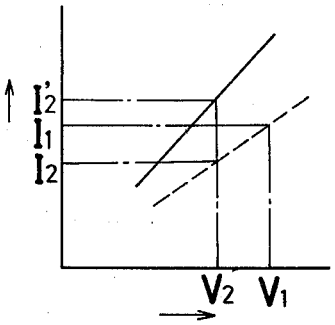
FIG. 4 is a graph representing the relationship between the voltage of a battery and the strength of the electric current supplied to the solenoid coil of the solenoid-actuated valve.

When the engine is started at a cold temperature below the limit temperature, electric current is supplied directly from the battery B to the solenoid coil 24. Since the second switch 40 is turned on prior to engine starting and the first switch 39 is turned on simultaneously with the ignition switch 41 upon engine starting, the required volume of air to the intake manifold will be provided in spite of a voltage drop in the battery at cold temperatures. This is more clearly understood by reference to the graph of FIG. 4. If the voltage of the battery B is, as indicated by $V_1$, the electric current, the strength of which is as indicated by $I_1$, will be supplied to the solenoid coil 24 through resistor 38 upon engine starting at normal temperature since the switch 40 is not turned on in this situation. Assuming that the voltage of the battery B is dropped from $V_1$ to $V_2$ at cold temperatures, the strength of the electric current supplied to the solenoid coil 24 will be dropped from $I_1$ to $I_2$ where the switches 39 and 40 are not provided to by-pass the resistor 38. Once the strength of the current supplied to the solenoid coil 24 drops to $I_2$, it is impossible to supply the required air volume to the intake manifold 13 since the solenoid-actuated valve 19 cannot be opened sufficiently. However, the strength of the current supplied to the solenoid coil 24 may be increased to $I_2$, in spite of the voltage drop of the battery B from $V_1$ to $V_2$ when the resistor 38 is by-passed by the closing of switches 39 and 40 thus making it possible to supply the intake manifold 13 with sufficient air even at very cold temperatures. Thus, the engine rotation speed will be stabilized at cold temperatures since sufficent air will be supplied to the intake manifold 13.

While the invention has been particularly shown and described with reference to a preferred embodiment thereof, it will be understood by those in the art that various changes in form and details may be made therein without departing from the spirit and scope of the invention.

What is claimed is:

1. An engine rotation speed control system for automotive vehicles having an internal combustion engine comprising a carburetor having an air intake passage, an intake manifold and a throttle valve disposed intermediate said air intake passage and said intake manifold, air passage means by-passing said throttle valve disposed in communication with said air intake passage and said intake manifold, a solenoid actuated valve provided with a solenoid coil disposed in said air passage means for controlling the amount of air by-passing said throttle valve when said throttle valve is closed during idling, a battery for supplying electric current to said solenoid coil, a resistor connecting said battery and one end of said solenoid coil, first and second switch means connected in series with each other and connected in parallel with said resistor, ignition switch means controlling said first switch and temperature sensitive means controlling said second switch whereby when said ambient temperature surrounding said engine is below a predetermined temperature said first and second switches will be closed upon operation of said ignition switch to by-pass said resistor and increase the current supplied to said solenoid coil.

2. An engine rotation speed control system as set forth in claim 1, further comprising sensor means for detecting various operating parameters of internal combustion engines and a control circuit incluing a pulse modulator and a switching transistor wherein said pulse modulator generates pulse signals the width of which depends on said parameters, said switching transistor connecting said pulse modulator and the other end of said solenoid coil for determining the strength of electric current to be supplied to said solenoid coil.

3. An engine rotation speed control system as set forth in claim 2, further comprising fuel injection means located in said carburetor downstream of said throttle valve and wherein said control circuit is operatively associated with said fuel injection means to determine optimum fuel injection timing and duration.

4. An engine rotation speed control system as set forth in claim 2, further comprising a diode interposed between said battery and said switching transistors so as to prevent reverse current to said switching transistor from said solenoid coil upon deenergization thereof.

* * * * *

UNITED STATES PATENT OFFICE

CERTIFICATE OF CORRECTION

Patent No. 4,303,048 Dated December 1, 1981

Inventor(s) Shigeru NISHIO

It is certified that error appears in the above-identified patent and that said Letters Patent are hereby corrected as shown below:

Col. 2, lines 22, 23, change "a carburator" to -- air intake passage --.

Col. 2, line 26, change "carburator" to -- air intake passage --

Col. 2, line 31, delete "of the carburator".

Col. 2., line 68, change "aid" to -- air --.

Col. 3, line 11, change "29" to -- 39 --.

Col. 4, line 19, delete "a carburetor having".

Col. 4, line 44, change "incluing" to -- including --.

Col. 4, line 53, change "carburetor" to -- intake manifold --.

Signed and Sealed this

Tenth Day of July 1984

[SEAL]

Attest:

GERALD J. MOSSINGHOFF

Attesting Officer

Commissioner of Patents and Trademarks